US007296523B1

(12) United States Patent
Yoon

(10) Patent No.: US 7,296,523 B1
(45) Date of Patent: Nov. 20, 2007

(54) SPACE-SAVING MOUNTING TABLE FOR USE WITH AN EQUIPMENT RACK

(75) Inventor: Seungyun Yoon, Upper Darby, PA (US)

(73) Assignee: Unisys Corporation, Blue Bell, PA (US)

( * ) Notice: Subject to any disclaimer, the term of this patent is extended or adjusted under 35 U.S.C. 154(b) by 299 days.

(21) Appl. No.: 10/734,856

(22) Filed: Dec. 12, 2003

(51) Int. Cl.
*A47B 11/00* (2006.01)

(52) U.S. Cl. ..... 108/103

(58) Field of Classification Search ..... 248/595, 248/596, 235, 239, 131, 186.1, 222.51, 349.1, 248/299.1; 5/81.1 R, 81.1 RP; 384/18, 384/19, 20, 21, 35, 424–427, 420; 108/102, 108/103, 105, 108, 137, 139, 140, 141, 142, 108/143, 94, 152, 65, 69, 78; 312/300, 302, 312/307, 310, 408; 211/165, 166, 144, 174, 211/150, 187, 81, 96, 162, 168, 129.1
See application file for complete search history.

(56) References Cited

U.S. PATENT DOCUMENTS

| | | | | | |
|---|---|---|---|---|---|
| 379,232 | A | * | 3/1888 | Larson | 312/307 |
| 771,877 | A | * | 10/1904 | Kuebler | 99/443 R |
| 908,394 | A | | 12/1908 | Corbeille | |
| 910,189 | A | * | 1/1909 | Fox | 379/446 |
| 1,197,420 | A | | 9/1916 | Wizorek | |
| 1,336,433 | A | * | 4/1920 | Hudson | 108/63 |
| 1,494,112 | A | * | 5/1924 | Hilger | 62/250 |
| 1,659,572 | A | * | 2/1928 | Klemm | 297/160 |
| 1,661,113 | A | | 2/1928 | Deshon | |
| 1,730,154 | A | * | 10/1929 | Loeb | 312/302 |
| 1,742,904 | A | * | 1/1930 | Follmer | 108/63 |
| 1,775,877 | A | * | 9/1930 | Waples | 108/94 |
| 1,898,562 | A | | 2/1933 | More | |
| 1,935,246 | A | * | 11/1933 | Kirsch | 403/205 |
| 2,023,826 | A | | 12/1935 | Van Buskirk | |
| 2,182,546 | A | | 12/1939 | Raymond | |
| 2,270,914 | A | * | 1/1942 | Williams | 221/46 |
| 2,293,496 | A | * | 8/1942 | Egger | 108/93 |
| 2,315,862 | A | * | 4/1943 | Ledbetter et al. | 312/329 |

(Continued)

FOREIGN PATENT DOCUMENTS

| | | | |
|---|---|---|---|
| DE | 3742813 | A1 * | 7/1989 |

(Continued)

*Primary Examiner*—Janet M. Wilkens
(74) *Attorney, Agent, or Firm*—Richard J. Gregson; Gary M. Cohen

(57) ABSTRACT

Components can be received within regions of limited access present in an equipment-supporting rack using an installation table including a pair of mounting plates which are pivotally connected to each other at a corner of the respective mounting plates. One mounting plate includes a bracket for fixed connection to the rack, and the other mounting plate includes a surface for receiving a desired component. Rotation of the mounting plate receiving the component relative to the mounting plate fixed to the rack permits the component to be conveniently accessed when servicing is desired, and returned to the region of limited access during normal system operations. A channel is preferably provided to guide and limit movement of the mounting plate which receives the component, and a locking mechanism is preferably provided for securing the mounting plate and the component it receives in desired position during normal system operations.

46 Claims, 7 Drawing Sheets

U.S. PATENT DOCUMENTS 2,332,291 A * 10/1943 Harder ..... 108/140
2,396,242 A * 3/1946 Harder ..... 297/158.2
2,605,153 A * 7/1952 Lietz ..... 108/93
2,614,861 A * 10/1952 Van Horn ..... 280/457
2,617,473 A * 11/1952 Krimstock et al. ..... 297/161
2,650,871 A * 9/1953 Holderegger ..... 312/322
2,680,314 A * 6/1954 Snyder ..... 108/39
2,727,156 A * 12/1955 Guentner et al. ..... 378/197
2,768,043 A * 10/1956 Kristoff et al. ..... 108/46
2,851,321 A * 9/1958 Malburg ..... 108/140
2,935,287 A * 5/1960 Higgins ..... 248/298.1
2,937,839 A * 5/1960 Randolph ..... 248/276.1
3,192,306 A * 6/1965 Skonnord ..... 174/16.1
3,604,669 A * 9/1971 Asher ..... 248/243
3,650,577 A * 3/1972 Gutner ..... 384/21
4,564,167 A 1/1986 Smith
4,697,778 A * 10/1987 Harashima ..... 248/349.1
4,893,747 A * 1/1990 Roth ..... 232/39
5,069,408 A * 12/1991 Bessinger ..... 248/250
5,079,789 A * 1/1992 Jandrakovic ..... 5/81.1 RP
5,080,322 A * 1/1992 Harley ..... 248/349.1
5,337,682 A * 8/1994 Wiseman ..... 108/94
5,400,958 A * 3/1995 Walker ..... 232/39
5,425,313 A * 6/1995 Rowan ..... 108/65
5,460,105 A * 10/1995 Given, Jr. ..... 108/137
5,553,351 A 9/1996 Starks
5,586,665 A 12/1996 Brousseau
5,671,653 A * 9/1997 Martensen et al. ..... 92/57
5,692,815 A * 12/1997 Murphy ..... 312/283
5,704,100 A 1/1998 Swan
5,711,053 A 1/1998 Hafner
5,887,962 A * 3/1999 Tsai ..... 312/351.9
6,044,984 A 4/2000 Crosby et al.
6,045,098 A * 4/2000 Timm ..... 248/118
6,056,378 A * 5/2000 Semon et al. ..... 312/246
6,076,846 A * 6/2000 Clardy ..... 280/290
6,079,081 A 6/2000 Padiak et al.
6,086,033 A 7/2000 Calleja
6,123,203 A * 9/2000 Gibbons ..... 211/26
6,158,360 A * 12/2000 Cheng ..... 108/103
6,206,495 B1 * 3/2001 Peterson ..... 312/283
6,354,550 B2 * 3/2002 Jeong ..... 248/299.1
6,435,462 B2 * 8/2002 Hawes ..... 248/299.1
6,484,987 B2 * 11/2002 Weaver ..... 248/278.1
6,523,223 B2 2/2003 Wang
6,568,772 B2 * 5/2003 Gerkey et al. ..... 312/238
6,615,744 B1 * 9/2003 Eckstein et al. ..... 108/147.2
6,701,575 B2 3/2004 Padiak et al.
6,709,184 B1 * 3/2004 McDonald ..... 403/98
6,823,805 B2 * 11/2004 Becker ..... 108/103
2003/0042830 A1 * 3/2003 Gregorio ..... 312/325
2004/0034969 A1 2/2004 Wegman

FOREIGN PATENT DOCUMENTS

JP 10153382 A * 6/1998

* cited by examiner

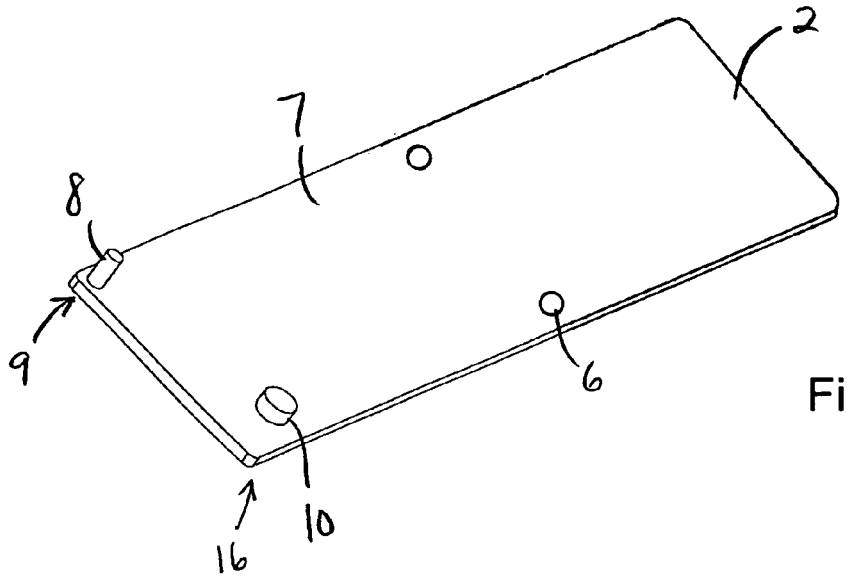
Fig. 4
Fig. 5
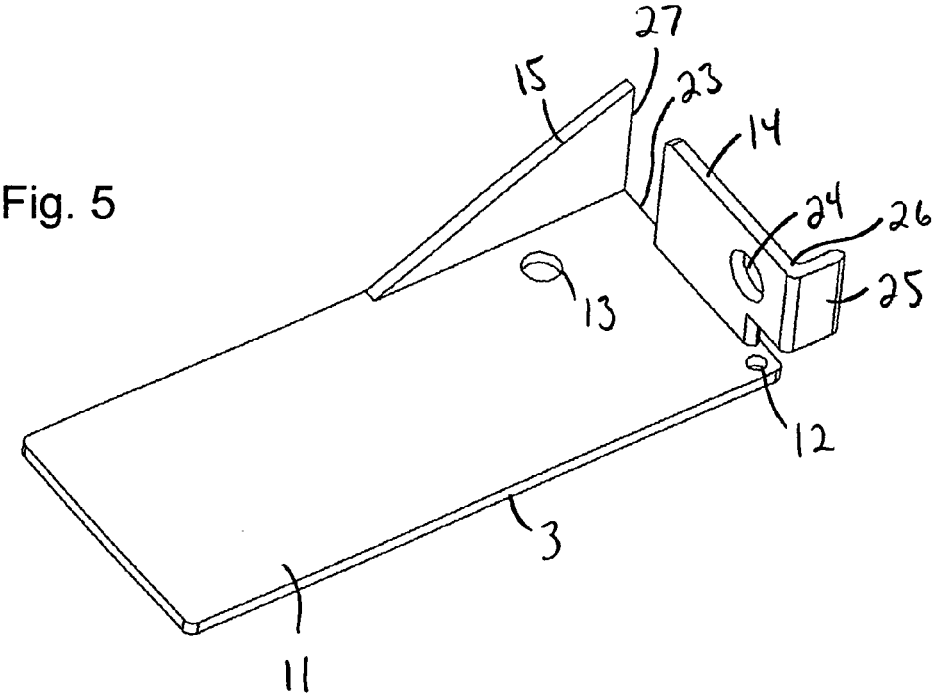

Fig. 6
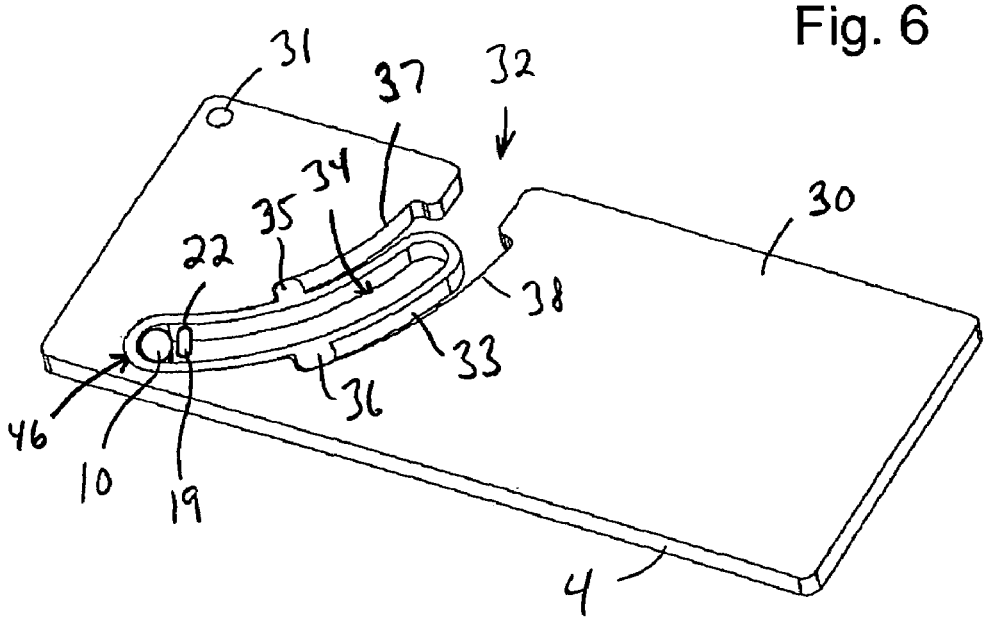
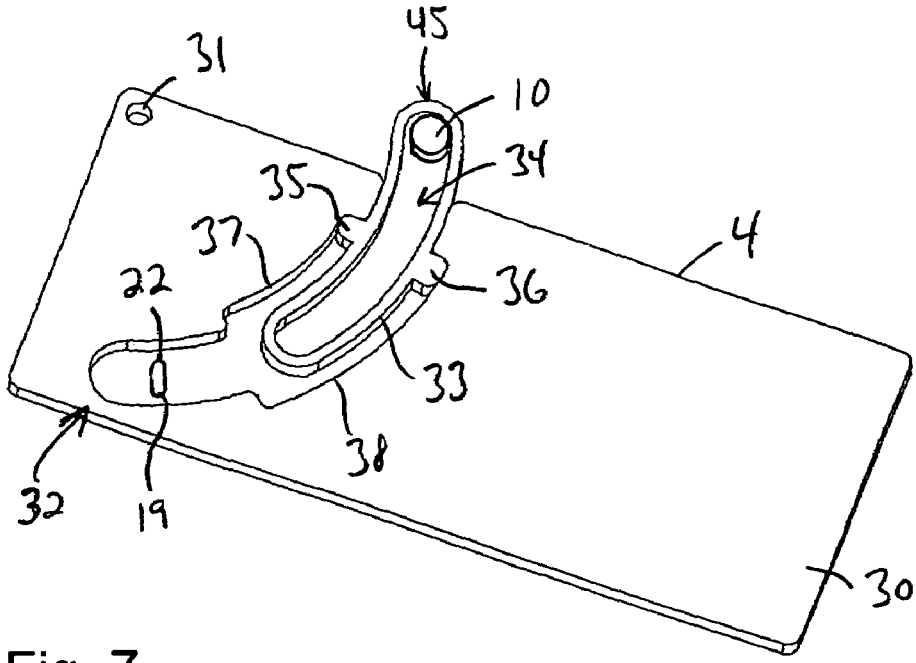
Fig. 7

SPACE-SAVING MOUNTING TABLE FOR USE WITH AN EQUIPMENT RACK

BACKGROUND OF THE INVENTION

This invention generally relates to racks and other types of chassis for receiving equipment, including but not limited to electronic equipment and the like, and more particularly, to a fixture for mounting such equipment in regions which are difficult to access.

Support frames, generally referred to in the industry as "racks", are conventionally used to receive desired electrical components such as circuit boards, modules or similar equipment and to support the received electrical components in desired position. Such racks can either be open, or enclosed to develop a housing (or cabinet) for receiving desired equipment.

Racks of this general type are conventionally comprised of a series of framing elements which are combined to develop an enclosure for the equipment which is to be received in the resulting structure. To this end, a series of brackets is generally connected between a pair of support plates to develop an open enclosure for receiving desired equipment. The brackets are then provided with a series of holes for cooperating with equipment which is to be received in the resulting rack.

In use, electrical equipment which is to be mounted in the rack is positioned between the opposing brackets and is attached to the brackets using conventional hardware. Electrical connections between electrical components mounted in the rack and support components for interfacing with the mounted electrical components (for example, power strips, hub switches, firewalls, etc.) are then established, generally to the rear of the rack.

To facilitate servicing of the electrical equipment mounted in the rack, including any system supporting components, it is often required to access such equipment and the electrical interconnections associated with such equipment through the rear of the rack, between the rearward brackets which comprise the rack. To permit free access to such equipment from the rear of the rack, it is generally necessary for such equipment to be located in regions of the rack where access will not be hampered by any interfering structures. This generally requires support components such as power strips, hub switches and firewalls to occupy regions of the rack which could otherwise be used to receive primary electrical components such as circuit boards, modules or similar electrical components.

Regions exist within the confines of the rack which could otherwise accept the relatively small support components which are used to interface with the remainder of the system, but for the need to be able to conveniently access such components. For example, power strips have at times been placed along the upper and/or lower regions of the rack, regions which are often used to house ducting and fans for ventilating the rack and the equipment mounted in the rack. Such placement avoids the need to position the power strips in regions of the rack which could otherwise be used to receive primary electrical components. However, placement of the power strips along the upper and/or lower regions of the rack has the corresponding disadvantage that significantly longer power cables are then required to connect the power strips with the electrical components which are to be supplied with power for operation. Moreover, some of the more recent racks which have been developed already make use of such space, in such cases preventing components from being positioned in such regions.

It would also be possible for relatively small support components such as power strips, hub switches and firewalls to be located in regions of the rack which are blocked by the support brackets which form the rack, but for the need to have to access the support components which are located in such "blind" spots, which will hereinafter be referred to as areas of "limited access". This would then free remaining space, which is otherwise freely accessible, to receive primary electrical components such as circuit boards, modules and the like.

SUMMARY OF THE INVENTION

In accordance with the present invention, relatively small components can be received within regions of limited access using an installation table including a pair of mounting plates which are pivotally connected to each other at a corner of the respective mounting plates. One of the mounting plates includes a mounting bracket for fixed connection to a framing element of the rack, and the other mounting plate includes a surface for receiving a desired component. Rotation of the mounting plate receiving the desired component relative to the mounting plate fixed to the framing element permits the component to be conveniently accessed when servicing is desired, and returned to the region of limited access during normal operations of the system.

A channel is preferably provided to guide and limit movement of the mounting plate which receives the component. A locking mechanism is preferably provided for securing the mounting plate and the component it receives in desired position during normal operations of the system.

BRIEF DESCRIPTION OF THE DRAWINGS

FIG. 4 is an isometric view of an upper mounting plate of the installation table, viewed from the bottom.

FIG. 5 is an isometric view of a lower mounting plate of the installation table, viewed from the bottom.

FIG. 6 is an isometric view of an intermediate plate for the installation table, showing a guide associated with the intermediate plate in a retracted position.

FIG. 7 is an isometric view of the intermediate plate, showing the guide in an extended position.

DETAILED DESCRIPTION OF THE INVENTION

Figure 1:
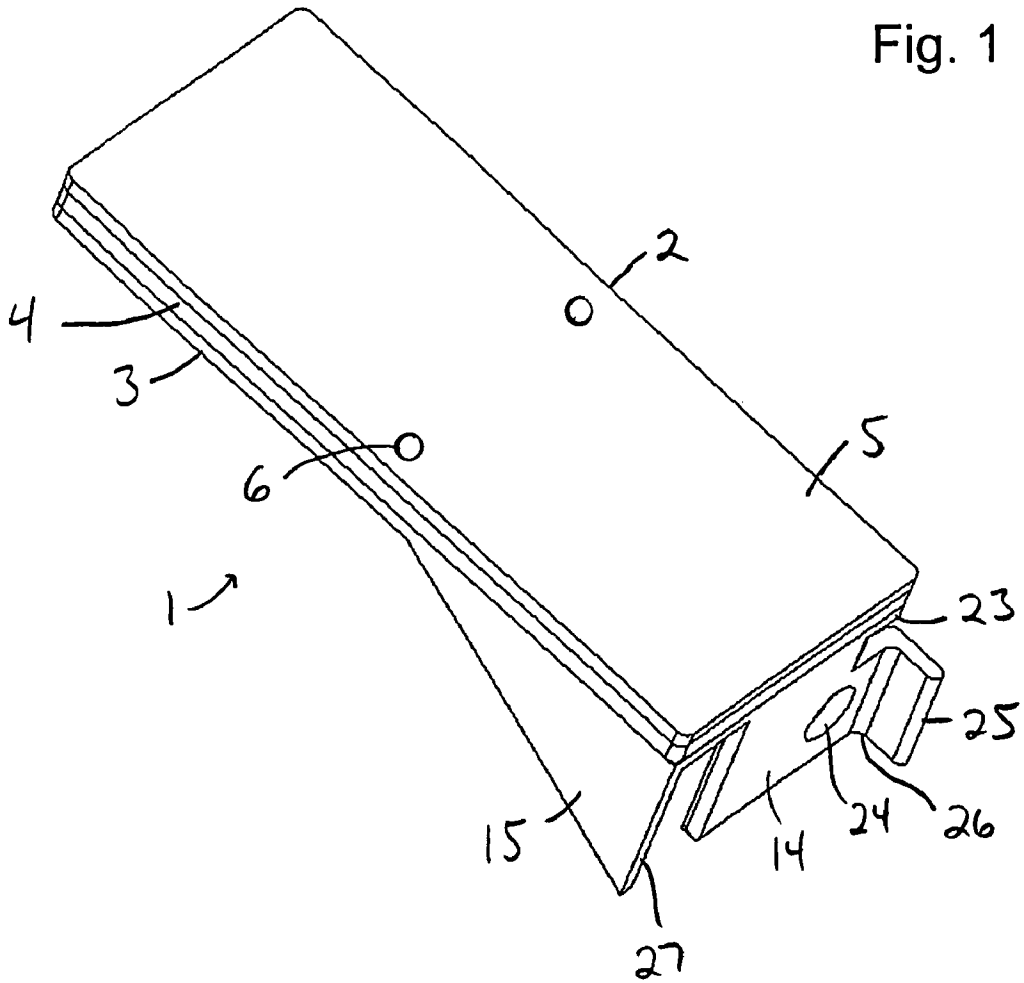
FIG. 1 is an isometric view of a preferred installation table of the present invention, in a closed position.
Figure 2:
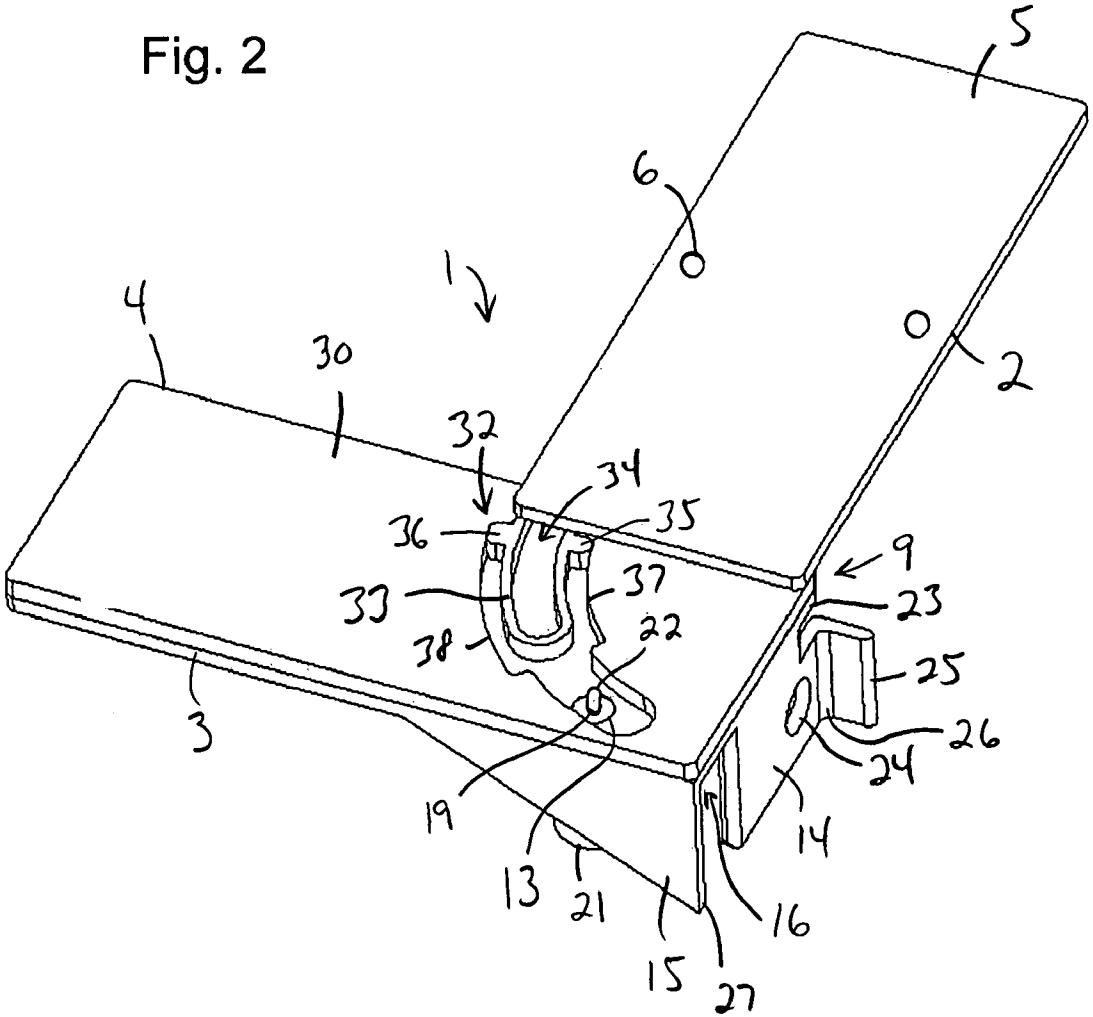
FIG. 2 is an isometric view of the installation table of FIG. 1 in an open position.
Figure 3:
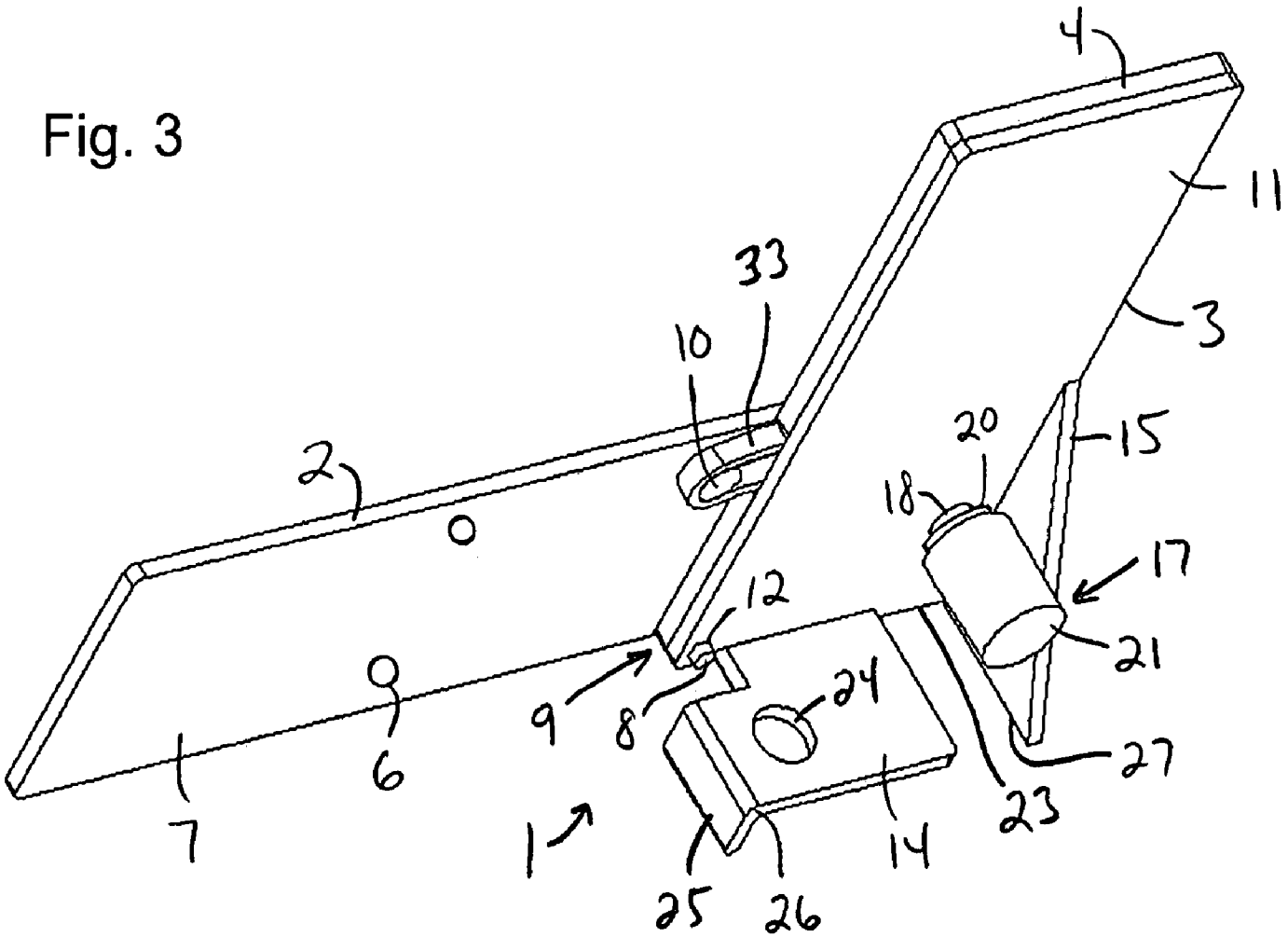
FIG. 3 is an isometric view of the installation table of FIG. 2 from the bottom.

FIGS. 1 to 3 show a preferred embodiment of the installation table 1 of the present invention. In FIG. 1, the installation table 1 is shown in a closed, or retracted position. FIGS. 2 and 3 show the installation table 1 in an open, or deployed position. The installation table 1 is generally comprised of a pair of mounting plates 2, 3 which are separated by an intermediate, bearing plate 4.

The upper mounting plate 2 includes a surface 5 for receiving desired components as will be described more fully below. In the configuration illustrated, the surface 5 is planar, with an overall rectangular shape, and one or more apertures 6 are provided in the surface 5 of the mounting plate 2 for securely receiving a component. Referring to FIG. 4, the underside 7 of the mounting plate 2 includes a pin 8 located in a corner 9 of the mounting plate 2, and a follower 10 on a side of the mounting plate 2 which opposes the pin 8.

Referring to FIG. 5, the lower mounting plate 3 includes a surface 11 having a pair of apertures 12, 13, and a pair of flanges 14, 15 for use in mounting and support of the installation table 1 as will be described more fully below.

In the configuration illustrated, the surface 11 is planar, with an overall rectangular shape, and preferably corresponds in shape to the overall configuration of the mounting plate 2. The surface 11 of the mounting plate 3, and the cooperating surface 5 of the mounting plate 2, are preferably planar in configuration to effectively mate with any of a variety of components. The surface 5 and/or the surface 11 can also have non-planar configurations, and additional openings (not shown) can also be provided, to facilitate the mating of components having irregular shapes with the installation table 1. The configuration of the surface 5 will ordinarily complement the configuration of the surface 11, although the use of surfaces 5, 11 having different configurations is equally possible if appropriate to receive a desired component.

The aperture 12 is located, and is sized to slidingly receive the pin 8 associated with the upper mounting plate 2. In this way, the upper mounting plate 2 and the lower mounting plate 3 are pivotally connected to each other at the corner 9 of the respective mounting plates 2, 3. Pivotal connection at the corner 9 is preferred to develop a clockwise rotation of the upper mounting plate 2 relative to the lower mounting plate 3 as the mounting plate 2 is deployed. A pivotal connection at the opposing corner 16 is preferred to develop a counter-clockwise rotation of the upper mounting plate 2 relative to the lower mounting plate 3 as the mounting plate 2 is deployed. Other placements for the resulting pivot point are also possible, if desired for a particular application.

The aperture 13 is provided to receive and cooperate with a locking mechanism 17, which is shown in FIG. 3. The locking mechanism 17 is itself known, and generally includes an outer barrel 18 and an inner plunger 19 separated by a spring 20. The outer barrel 18 is fixed to the surface 11 of the lower mounting plate 3 so that the plunger 19 extends through the aperture 13. Retraction of the plunger 19, for example, by grasping the cap 21 of the plunger 19, causes the tip 22 of the plunger 19 (see FIG. 2) to withdraw from the aperture 13 against the forces developed by the spring 20, establishing a position for releasing the upper mounting plate 2 for rotation as will be described more fully below. Release of the cap 21 of the plunger 19 permits the tip 22 to resume its passive position, once again extending through the aperture 13, and establishing a position for locking the upper mounting plate 2 in a closed position, as will be described more fully below.

The flange 14 depends from an edge 23 of the lower mounting plate 3, and includes an aperture 24 for receiving conventional hardware for mounting the installation table 1 to a rack as will be described more fully below. A corner 25 preferably extends from an end 26 of the flange 14 to assist in stabilizing the installation table 1 against the rack which is to receive it, by preventing longitudinal rotation of the installation table 1 relative to the support structure which receives the installation table 1.

The flange 15 depends from an edge 27 of the lower mounting plate 3, which is preferably adjacent to the edge 26 which receives the flange 14, to provide vertical support for the installation table 1 and the component which is to be mounted using the installation table 1. The shape and configuration of the flanges 13, 14 can be freely varied, as needed, to suit a particular rack configuration or to effectively receive and support a desired component.

The upper mounting plate 2 and the lower mounting plate 3 can be directly combined to yield an effective structure for receiving components and for mounting the received components in a rack. It would also be possible to lubricate the interface between such components, to provide enhanced operation, or to separate such components with a friction-reducing (for example, a friction-reducing plastic) layer, if desired. In a particularly preferred embodiment, the intermediate, bearing plate 4 is positioned between the upper mounting plate 2 and the lower mounting plate 3 to enhance operations of the installation table 1.

Referring to FIG. 6 (and FIG. 2), the surface 30 of the bearing plate 4 is similar in configuration to the surface 5 of the upper mounting plate 2 and the surface 11 of the lower mounting plate 3. To this end, the surface 30 is preferably planar, with an overall rectangular shape. As with the upper mounting plate 2 and the lower mounting plate 3, the configuration of the surface 30 of the bearing plate 4 can freely be varied to suit a particular application, as desired.

The bearing plate 4 includes an aperture 31 and a channel 32. The aperture 31 is sized and positioned to cooperate with the pin 8 of the upper mounting plate 2 so that, following assembly, the aperture 31 is in general alignment with the pin 8 of the upper mounting plate 2 and the receiving aperture 12 of the lower mounting plate 3. The channel 32 preferably receives a guide 33 which operates to facilitate rotation of the upper mounting plate 2 relative to the lower mounting plate 3.

The guide 33 and the channel 32 are complementary and are both generally arc-shaped in overall configuration.

Central regions 34 of the guide 33 are open, and following assembly of the installation table 1, slidingly receive the follower 10 depending from the upper mounting plate 2 for movement along an arcuate path which is defined by the central regions 34. The guide 33 is in turn slidingly received within the channel 32, for movement along an arcuate path which is defined by the channel 32. A pair of tabs 35, 36 project from opposing sides of the guide 33, and are received in a corresponding pair of detents 37, 38 formed in the bearing plate 4. As is best shown in FIGS. 6 and 7, the tab 35 associated with the detent 37 is preferably smaller than the tab 36 associated with the detent 38 so that the tabs 35, 36 simultaneously contact the ends of the detents 37, 38 when the guide 33 assumes either its fully extended (FIG. 7) or fully retracted (FIG. 6) position.

The plates 2, 3, 4 and the guide 33 can be formed of any of a variety of materials. Plates 2, 3, 4 formed of metal are preferred, although plastic materials could also be used, if desired. The guide is preferably formed of a plastic material, to facilitate movement of the upper plate 2 relative to the lower plate 3, although the guide 33 could also be formed of a metal if desired. A particularly useful material for forming the guide 33 is a friction-reducing plastic material, such as "Celcon GC-25A", a glass-filled acetal copolymer which is available from the Celanese Corporation of America.

Figure 8:
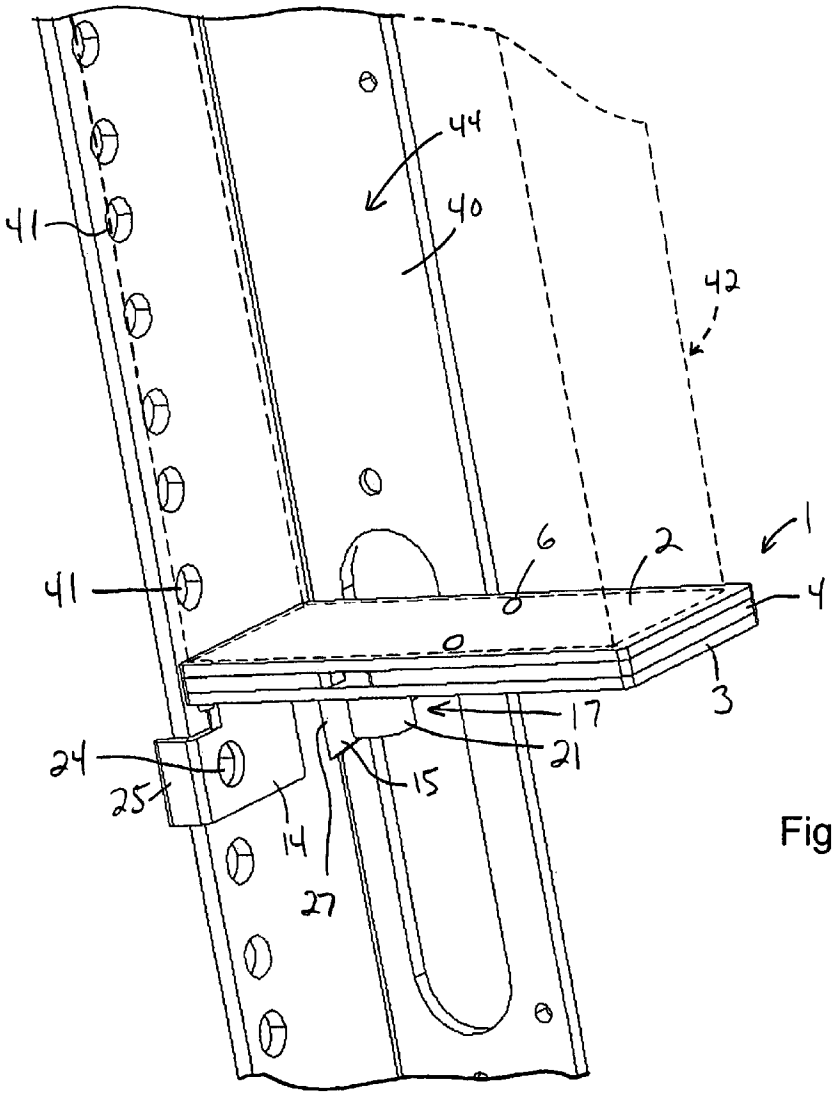
FIG. 8 is an isometric view of an installation table mounted to the support bracket of a rack, with the upper mounting plate in a retracted position.
Figure 9:
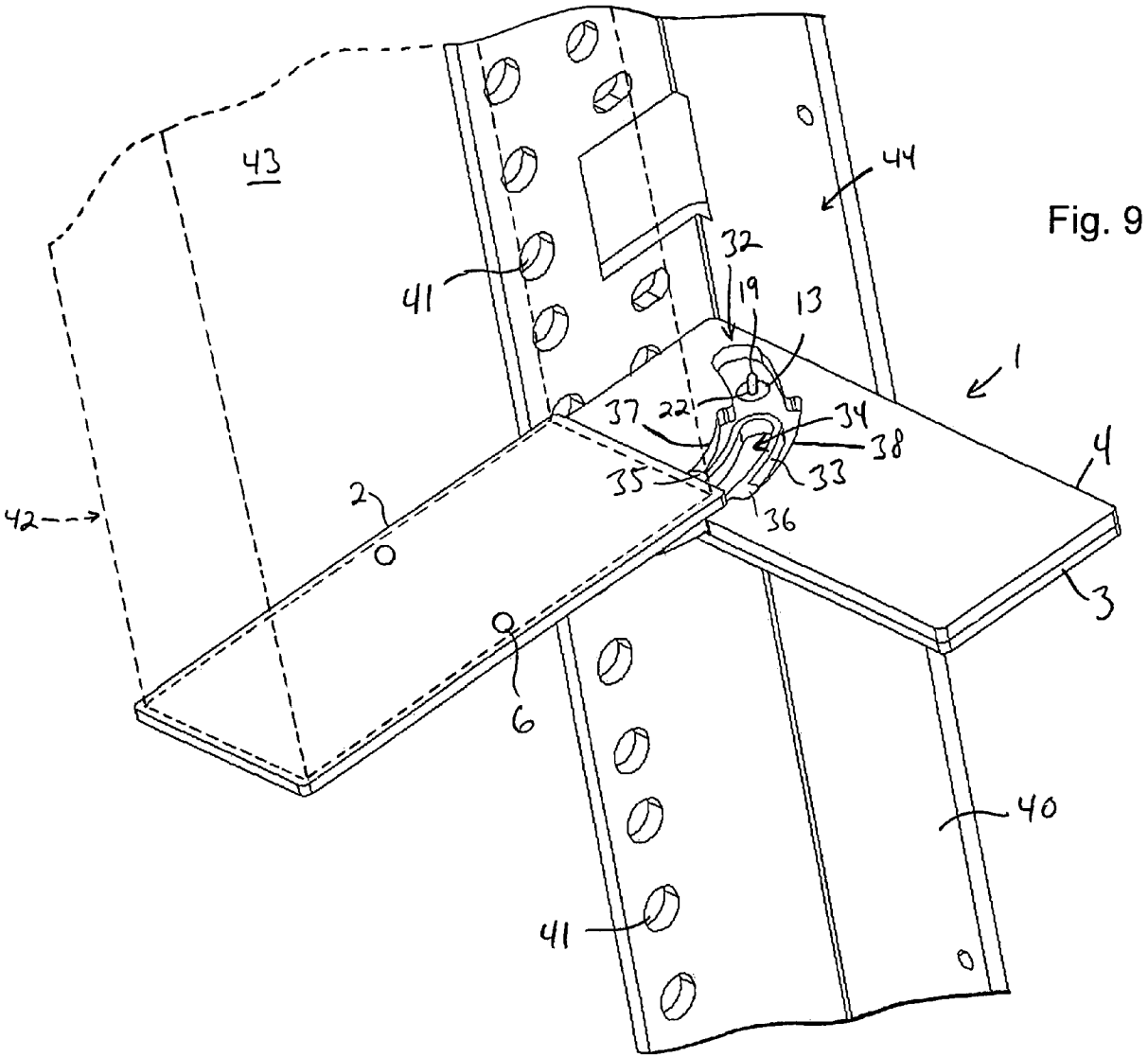
FIG. 9 is an isometric view of an installation table mounted to the support bracket of a rack, with the upper mounting plate in an extended position.

FIGS. 8 and 9 show an installation table 1 mounted to the support 40 of a rack for receiving desired components (not shown). The support 40 has the usual shape of an angle-bracket, and includes a series of apertures 41 for receiving conventional hardware (for example, screws, bolts, or other threaded, or other types of fasteners) in conventional fashion. In accordance with the present inventions the installation table 1 is positioned on an inside corner of the support 40, with the flange 14 facing the rear of the support 40. When in its desired position, and at its desired height, the aperture 24 in the flange 14 of the installation table 1 is aligned with one of the apertures 41 in the support 40, and desired hardware (not shown) is inserted through the apertures 24, 41 to fix the installation table 1 to the support 40. This brings the corner 25 of the flange 14, and the flange 15, into engagement with the support 40, providing structural and weight-bearing support for the installation table 1 and a component 42 (shown in phantom) received by the installation table 1. An end of the component 42 is conveniently fixed to the upper mounting plate 2 using, for example, conventional hardware engaging the apertures 6 formed in the surface 5 of the mounting plate 2.

To be noted is that the preferred rectangular shape for the plates 2, 3, 4 causes such structures to follow the contour of the adjacent support 40, maximizing the support surfaces which are available for receiving a desired component. Also to be noted is that the pin 8 will then be located on the side of the installation table 1 about which the upper mounting plate 2 is to rotate, leaving the upper mounting plate 2 free to rotate relative to the lower mounting plate 3. It will be understood that a mirror-image placement of such structures would be established for an installation table which is to be affixed to a support (not shown) positioned on an opposing side of the rack.

Let it now be assumed that a servicing procedure is called for which requires the component 42 mounted to the installation table 1 to be accessed. Because such servicing would ordinarily take place from the rear of the rack (from the position 43 shown in FIGS. 8 and 9), the support 40 would then prevent the component 42 from being conveniently accessed. The installation table 1 allows the component 42 to be withdrawn from the region of limited access 44 which receives the component 42 to permit convenient servicing of the component 42.

To accomplish this, and additionally referring to FIGS. 6 and 7, the cap 21 of the plunger 19 of the locking mechanism 17, if used, is grasped and pulled down. This operates to release the tip 22 of the plunger 19, shown in FIG. 6. The component 42, or the upper mounting plate 2, is grasped and rotated outwardly about the pivoting pin 8 to assume a deployed position which is preferably normal to the lower mounting plate 3, as shown in FIG. 9. In the fully deployed position, the guide 33 will be in its fully extended position and the follower 10 will lie at the outer end 45 of the central regions 34 of the guide 33, as shown in FIG. 7. In this way, outward movement of the component 42 will be limited by interaction between the guide 33, the channel 32 of the bearing plate 4 and the follower 10 of the upper mounting plate 2. Convenient servicing of the component 42 can then proceed, as desired, with the component 42 (and the upper mounting plate 2) in an orientation which laterally projects from the region 44.

Following desired servicing of the component 42, the component 42 is conveniently pushed back along the path defined by the guide 33. Initially, this will bring the follower 10 in contact with the end 46 of the guide 33, in turn pushing the guide 33 into the channel 32. The guide 33 will eventually come to a fully retracted position, with the follower 10 lying against the end 46 of the central regions 34 of the guide 33 and with the guide 33 fully retracted into the channel 32, as shown in FIG. 6. In this way, the component 42 will be returned to the region 44, which could not otherwise be accessed because of the blocking support 40, and which could not otherwise be used to receive a component requiring any servicing. If a locking mechanism 17 is employed, the cap 21 of the plunger 19 would be grasped and retracted as the follower 10 moves to the end 46 of the guide 33, serving to lock the upper mounting plate 2, and the component 42, in the retracted position.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A fixture for mounting a component to a rack for supporting a plurality of components, comprising:

a first plate having a surface for receiving the component; and a second plate having a surface for attachment to the rack and cooperating with the first plate to form a combination of mounting plates;

wherein the first plate is pivotally connected to the second plate so that, in a first position, the first plate is adjacent to and in substantial alignment with the second plate and, in a second position, the first plate is rotated to an orientation which laterally projects from the second plate; and wherein the first plate is pivotally connected to the second plate by a connection including a single pivot pin extending from one of the mounting plates engaging an aperture formed in another one of the mounting plates;

a bearing plate separating the first plate and the second plate, wherein the bearing plate is formed of a friction-reducing plastic material; and a locking mechanism fixed to the second plate and having a retractable tip extending through the second plate and selectively engaging the first plate.

2. The fixture of claim 1 wherein the connection including the pin and the aperture is positioned at a corner of the mounting plates.

3. The fixture of claim 1 wherein the second position of the first plate is substantially normal to the first position of the first plate.

4. The fixture of claim 1 wherein the first plate and the second plate have a substantially rectangular shape.

5. The fixture of claim 1 wherein the first plate includes a follower depending from the surface of the first plate, and wherein the bearing plate includes a channel formed in the bearing plate for receiving the follower depending from the first plate.

6. The fixture of claim 5 wherein the channel has an arcuate shape.

7. The fixture of claim 5 which further includes a guide slidingly received in the channel and between the first plate and the second plate, for limiting rotation of the first plate relative to the second plate.

8. The fixture of claim 7 wherein the guide is formed of a friction-reducing plastic material.

9. The fixture of claim 7 wherein the guide further includes at least one tab laterally projecting from the guide and slidingly received in the channel, and wherein the channel includes at least one detent for receiving the tab projecting from the guide.

10. The fixture of claim 9 wherein the guide includes an opposing pair of tabs laterally projecting from the guide and slidingly received in the channel, and wherein the channel includes an opposing pair of detents for receiving the tabs projecting from the guide.

11. The fixture of claim 10 wherein the pair of tabs engage first ends of the detents when the first plate is in the first position, and wherein the pair of tabs engage second ends of the detents opposite to the first ends when the first plate is in the second position.

12. The fixture of claim 5 wherein the retractable tip extends through the second plate and into the channel of the bearing plate, for selectively engaging the follower of the first plate.

13. The fixture of claim 1 wherein the second plate further includes a first bracket depending from a first edge of the second plate, and wherein the first bracket includes an aperture for receiving hardware for attaching the second plate to the rack.

14. The fixture of claim 13 wherein the first bracket includes a corner piece extending from an edge of the first bracket, for engaging portions of the rack to support the second plate in position.

15. The fixture of claim 13 wherein the second plate further includes a second bracket depending from a second edge of the second plate adjacent to the first edge, and wherein the second bracket includes a surface for engaging portions of the rack for supporting the second plate in position.

16. The fixture of claim 1 wherein the locking mechanism is fixed to a lower surface of the second plate.

17. A fixture for mounting a component to a rack for supporting a plurality of components, consisting essentially of:

a first plate associated with the fixture having a surface for receiving the component; and a second plate associated with the fixture having a surface for attachment to the rack and cooperating with the first plate to form a combination of mounting plates;

wherein the first plate is pivotally connected to the second plate by a connection including a single pivot pin extending from a corner of one of the mounting plates engaging an aperture formed in a corner of another one of the mounting plates so that, in a first position, the first plate is adjacent to and in substantial alignment with the second plate and, in a second position, the first plate is rotated to an orientation which laterally projects from the second plate; and a locking mechanism fixed to the second plate and having a retractable tip extending through the second plate and selectively engaging the first plate.

18. The fixture of claim 17 wherein the second position of the first plate is substantially normal to the first position of the first plate.

19. The fixture of claim 17 wherein the locking mechanism is fixed to a lower surface of the second plate.

20. A fixture in combination with a component and a rack for supporting a plurality of components, for mounting the component to the rack, wherein the rack is comprised of a plurality of supports which combine to define a region for receiving the plurality of components which includes first portions for freely accessing the components, and second portions defining an area of limited access which is at least partially blocked by the supports of the rack, and wherein the fixture comprises:

a first plate associated with the fixture having a surface which receives the component; and a second plate associated with the fixture having a surface attached to the rack and cooperating with the first plate to form a combination of mounting plates;

wherein the first plate is pivotally connected to the second plate by a connection including a pivot pin extending from a corner of one of the mounting plates engaging an aperture formed in a corner of another one of the mounting plates so that, in a first position, the first plate is located within the second portions of the region defined by the plurality of supports, adjacent to and in substantial alignment with the second plate and, in a second position, the first plate is rotated to an orientation which laterally projects from the second plate and which is located within the first portions of the region defined by the plurality of supports.

21. The fixture of claim 20 wherein the second position of the first plate is substantially normal to the first position of the first plate.

22. The fixture of claim 20 which further includes a bearing plate separating the first plate and the second plate.

23. The fixture of claim 22 wherein the first plate includes a follower depending from the surface of the first plate, and wherein the bearing plate includes a channel formed in the bearing plate for receiving the follower depending from the first plate.

24. The fixture of claim 23 wherein the channel has an arcuate shape.

25. The fixture of claim 23 which further includes a guide slidingly received in the channel and between the first plate and the second plate, for limiting rotation of the first plate relative to the second plate.

26. The fixture of claim 25 wherein the guide is formed of a friction-reducing plastic material.

27. The fixture of claim 25 wherein the guide further includes at least one tab laterally projecting from the guide and slidingly received in the channel, and wherein the channel includes at least one detent for receiving the tab projecting from the guide.

28. The fixture of claim 27 wherein the guide includes an opposing pair of tabs laterally projecting from the guide and slidingly received in the channel, and wherein the channel includes an opposing pair of detents for receiving the tabs projecting from the guide.

29. The fixture of claim 28 wherein the pair of tabs engage first ends of the detents when the first plate is in the first position, and wherein the pair of tabs engage second ends of the detents opposite to the first ends when the first plate is in the second position.

30. The fixture of claim 23 which further includes a locking mechanism fixed to the second plate and having a tip extending through the second plate and into the channel of the bearing plate, for selectively engaging the follower of the first plate.

31. The fixture of claim 20 wherein the second plate further includes a first bracket depending from a first edge of the second plate, and wherein the first bracket includes an aperture which receives hardware attaching the second plate to the rack so that the second plate is located within the second portions of the region defined by the plurality of supports.

32. The fixture of claim 31 wherein the first bracket includes a corner piece extending from an edge of the first bracket which engages portions of the rack to support the second plate in position within the second portions of the region defined by the plurality of supports.

33. The fixture of claim 31 wherein the second plate further includes a second bracket depending from a second edge of the second plate adjacent to the first edge, and wherein the second bracket includes a surface which engages portions of the rack for supporting the second plate in position within the second portions of the region defined by the plurality of supports.

34. The fixture of claim 20 which further includes a locking mechanism fixed to the second plate and having retractable portions extending through the second plate and selectively engaging the first plate.

35. The fixture of claim 34 wherein the locking mechanism is fixed to a lower surface of the second plate.

36. The fixture of claim 20 wherein the supports include brackets forming a right angle, wherein the first plate and the second plate have a substantially rectangular shaper and wherein the first plate and the second plate are located within the second portions of the region defined by the plurality of supports when the first plate is in the first position.

37. The fixture of claim 20 wherein an end of the component is connected to the first plate of the fixture.

38. A fixture for mounting a component to a rack for supporting a plurality of components, consisting essentially of:

a first plate associated with the fixture having a surface for receiving the component; and a second plate associated with the fixture having a surface for attachment to the rack and cooperating with the first plate to form a combination of mounting plates;

wherein the first plate is pivotally connected to the second plate by a connection including a single pivot pin extending from a corner of one of the mounting plates engaging an aperture formed in a corner of another one of the mounting plates so that, in a first position, the first plate is adjacent to and in substantial alignment with the second plate and, in a second position, the first plate is rotated to an orientation which laterally projects from the second plate;

a bearing plate separating the first plate and the second plate; and a locking mechanism fixed to the second plate and having a retractable tip extending through the second plate and selectively engaging the first plate.

39. The fixture of claim 38 wherein the first plate includes a follower depending from the surface of the first plate, and wherein the bearing plate includes a channel formed in the bearing plate for receiving the follower depending from the first plate.

40. The fixture of claim 39 wherein the channel has an arcuate shape.

41. The fixture of claim 39 which further includes a guide slidingly received in the channel and between the first plate and the second plate, for limiting rotation of the first plate relative to the second plate.

42. The fixture of claim 41 wherein the guide is formed of a friction-reducing plastic material.

43. The fixture of claim 41 wherein the guide further includes at least one tab laterally projecting from the guide and slidingly received in the channel, and wherein the channel includes at least one detent for receiving the tab projecting from the guide.

44. The fixture of claim 43 wherein the guide includes an opposing pair of tabs laterally projecting from the guide and slidingly received in the channel, and wherein the channel includes an opposing pair of detents for receiving the tabs projecting from the guide.

45. The fixture of claim 44 wherein the pair of tabs engage first ends of the detents when the first plate is in the first position, and wherein the pair of tabs engage second ends of the detents opposite to the first ends when the first plate is in the second position.

46. The fixture of claim 39 which further includes the retractable tip extending through the second plate and into the channel of the bearing plate, to selectively engage the follower of the first plate.

* * * * *